United States Patent [19]

Feibelman

[11] 4,332,320

[45] Jun. 1, 1982

[54] PENDANT DISPLAY CARD

[75] Inventor: Jeffrey A. Feibelman, Cranston, R.I.

[73] Assignee: A & H Mfg. Co., Johnston, R.I.

[21] Appl. No.: 201,170

[22] Filed: Oct. 27, 1980

[51] Int. Cl.[3] ..... B65D 85/56; B65D 85/58

[52] U.S. Cl. ..... 206/45.14; 206/464; 206/487; 206/490; 206/566

[58] Field of Search ..... 206/566, 557, 495, 45.14, 206/464, 487, 490, 562

[56] References Cited

U.S. PATENT DOCUMENTS

| | | | |
|---|---|---|---|
| 831,388 | 9/1906 | Smith | 206/566 |
| 3,280,972 | 10/1966 | Thomas | 206/495 |
| 3,858,718 | 1/1975 | Roy | 206/557 |
| 4,099,611 | 7/1978 | Feibelman | 206/566 |

*Primary Examiner*—William T. Dixson, Jr.
*Attorney, Agent, or Firm*—Salter & Michaelson

[57] ABSTRACT

A jewelry display card is disclosed that includes a cellulosic card having means formed thereon for suspending said card from a support. A flexible synthetic foam sheet is fixed to said card with at least a portion of its perimeter bonded to said card to form an enclosure suitable for supporting an article of jewelry. The enclosure may be located on the forward side of the card for displaying the article of jewelry thereon, or may be located on the rear side of the card for containing a portion of a jewelry article therein such as a chain which is interconnected to an article of jewelry that is displayed on the front side of the card.

9 Claims, 9 Drawing Figures

PENDANT DISPLAY CARD

BACKGROUND OF THE INVENTION

The present invention relates to jewelry display cards which have particular application in the display and marketing of ornamental jewelry.

Prior to the instant invention, an article of jewelry has usually been displayed on a display card by the attachment thereof on the front side of the card by the means that is normally used for mounting the article on the body or apparel of the wearer. A display device of this type has been found to be generally effective for displaying ornaments or articles of jewelry such as pins of brooches which were mounted only on the front side of the card. However, the card was subject to wear and soiling due to handling which detracted from the appearance thereof. The present invention provides an improvement over the conventional display card of this type by providing a more attractive and durable display device.

When the ornament, or article of jewelry to be displayed includes or is attached to a chain or necklace, the display thereof in a neat and attractive fashion is more difficult to accomplish since a major portion of the chain must be hidden from view in a contained manner. In the display of an article that includes ornamental chain, a portion of the chain or an ornament attached thereto has usually been suspended from the front side of a display card. A small paper envelope has been provided on the reverse side of the card to store the chain and conceal it from view. The use of a small paper envelope, however, has not always been an effective solution to the problem of containing the chain in place, since the chain may not always be effectively retained in the envelope and may fall out of the envelope when the card is tilted or moved. Also the paper envelope eventually becomes soiled and torn reducing its effectiveness as an attractive display device.

SUMMARY OF THE INVENTION

The present invention relates to jewelry display cards which may be used for attractively displaying jewelry including necklaces, chains, brooches or the like from display racks. The jewelry display card of the present invention includes a card of a cellulosic material such as acetate which is hung or suspended from a display rack. The card of the subject invention also includes a synthetic foam rubber sheet which is bonded around at least a portion of its perimeter to the cellulosic card.

In one embodiment of the invention, the synthetic foam sheet is bonded to the card around its entire perimeter. By bonding the perimeter of the foam sheet, a center pad is provided which serves to support a brooch or a pin for display. The pin is inserted through the foam rubber pad whereby the pad supports the article and displays it attractively.

Alternatively, in other forms of the invention only a portion of the perimeter of the foam sheet is bonded to the card to provide a pouch or an envelope. In this form of the invention the pouch or envelope is located on the rear side of the display card, the opposite face of the card being covered with a decorative fabric or flocked material which serves as a background for the display. In this construction an ornamental article is displayed on the front side of the card and overlies the fabric or flocked material, while the chain to which the article is attached is retained and supported in the pouch on the rear surface thereof. In order to support the article, slots are provided on the side edges of the card. The chain extends from the front of the card, through the slots and into the pouch located on the rear surface of the card.

Accordingly it is an object of the invention to provide an attractive display device on which an article of jewelry may be fastened and displayed.

Another object of the invention is to provide an attractive display device for a necklace, a chain, or a chain with a pendant so that a portion of the chain, necklace or pendant may be displayed on the front side of the card with the remainder of the chain hidden from view on the rear of the card.

Still another object of this invention is to provide a jewelry display card made from a cellulosic material and synthetic foam which is attractive and durable and which can be mass produced inexpensively.

Other objects, features and advantages of the invention shall become apparent as the description thereof proceeds when considered in connection with the accompanying ilustrative drawings.

DESCRIPTION OF THE DRAWINGS

In the drawings which illustrate the best mode presently contemplated for carrying out the present invention.

DESCRIPTION OF THE INVENTION

Figure 1:
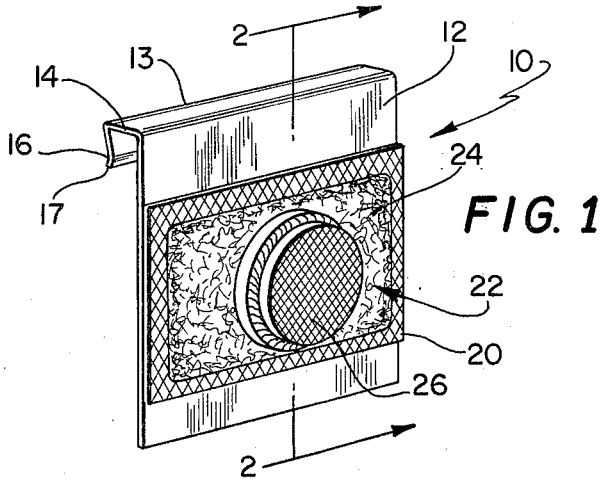
FIG. 1 is a perspective view of a display device showing one form of the invention embodied herein.

Referring now to the drawings and particularly to FIG. 1 thereof, one form of the display device of the present invention is illustrated and is generally indicated at 10. The display device 10 includes a generally rectangular, flat, card 12 made of a cellulosic material such as acetate to which a rear hanger member 13 is joined. The hanger member 13 is defined by a rearwardly extending flange 14 and a downwardly extending flange 16 that is joined to the flange 14, the flange 16 terminating in a rearwardly extending lip 17. It is seen that the hanger member 13 is shaped and constructed so that the display device 10 can be suspended from a rod that is formed as part of a display rack or display stand. Fixed to the card 12 is a synthetic foam sheet generally indicated at 22 which is bonded to the card 12 around the perimeter thereof indicated at 20 thereby leaving an unbonded center area or pad 24 on the sheet 22 which may be used to support a pin or brooch indicated at 26 in FIGS. 1 and 2.

Figure 2:
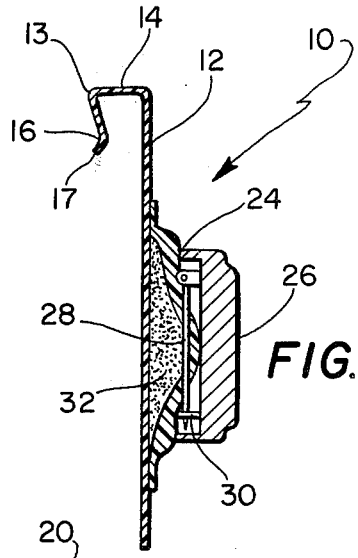
FIG. 2 is a side sectional view taken along line 2—2 in FIG. 1.

As illustrated in FIG. 2, the brooch 26 includes a pivotally mounted pin 28 that is securable to a clasp 30 in the conventional manner. The brooch 26 is supported on the card 10 by inserting the pin 28 through the unbonded pad section 24 of the sheet 22, the pin 28 passing through a void or space 32 that is formed between the unbonded pad section 24 and the card 10. The pin 28 also penetrates the unbonded pad section 24 at a second point, whereafter the pin 28 is secured to the clasp 30 to effectively support the brooch 26 on the card 12. In this embodiment of the invention, the sheet 22 provides a durable and effective means for pinning the brooch 26 or a pin to the card, whreby the card 12 may be displayed and supported on a display rack by the rear hanger member 13. It is also understood that the sheet 22 provides an attractive background for the display of the brooch 26.

Figure 3:
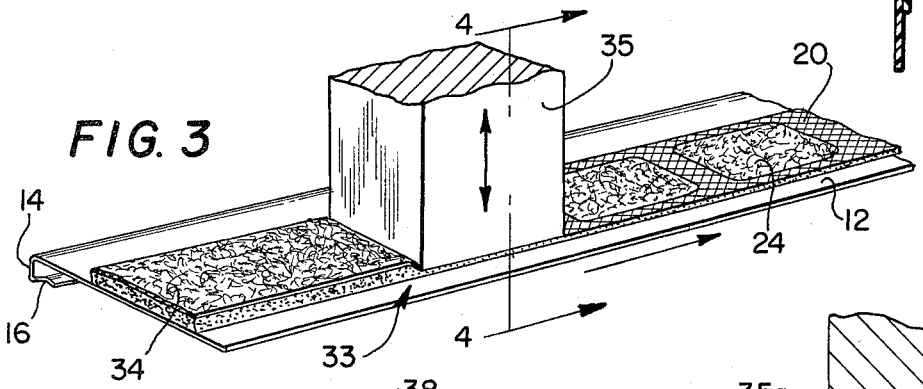
FIG. 3 is a perspective view of an elongated acetate member and a die used therewith illustrating a method by which the display device of the subject invention is mass produced.
Figure 4:
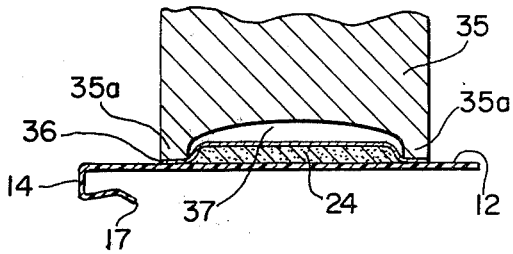
FIG. 4 is a sectional view taken along line 4—4 of FIG. 3.

Referring to FIGS. 2 and 3, a method of manufacturing the display device 10 in quantity is illustrated. As shown, the method provides for using an elongated sheet generally indicated at 33 that is formed of acetate and that is extruded in a continuous form with a cross-section similar to that of the card 12 as shown in FIG. 2. Following the extrusion of the elongated sheet 33, an elongated flexible synthetic foam sheet 34 is positioned longitudinally thereon, the sheet 34 occupying less than the full width of the sheet 33. In order to bond the sheet 34 to the sheet 33, a die 35 is provided and includes raised lips 35*a* that are formed with contact faces 36. The contact faces 36 engage the adjacent surfaces of the sheet 34 and produce a sealing action between the sheet 33 and 34 to form a seam area that corresponds to the perimeter areas 20 of the foam pad 24 as shown in FIG. 1. The die 35 is periodically moved into engagement with the sheets 33 and 34 as they are longitudinally moved thereunder to form a series of the spaced foam pads 24 bounded by the perimeter areas 20.

Various methods may be utilized for sealing the foam sheet 34 to the acetate sheet 33 such as heat sealing, adhesive bonding or ultrasonic bonding. It has been found that the use of ultrasonic bonding is an exceptionally effective method of adhering the two sheets together in mass production. In this regard particular reference is made to U.S. Pat. Nos. 3,224,916; 3,367,809; 3,440,117; 3,499,808; 3,563,822; and 3,595,453. By employing the ultrasonic bonding method, the necessity for the use of messy adhesives between the card and the pad is avoided. Production waste is also reduced to a minimum when ultrasonic bonding is used. It will also be seen that the ultrasonic bonding method, with the die 35 modified as required, can be advantageously employed to mass produce the other display devices that are described hereinafter and that are illustrated in FIGS. 5 through 9.

As described above, as the foam sheet 34 is sealed to the acetate sheet 33 at regular intervals, an elongated continuous strip of the display device 10 is produced that is formed with the void spaces 24 and bonded areas 20. The elongated strip is then cut in any appropriate manner to form the individual display devices 10 as shown in FIG. 1, each display device 10 including the bonded section 20, unbonded section 24 and void or space 32.

Figure 5:
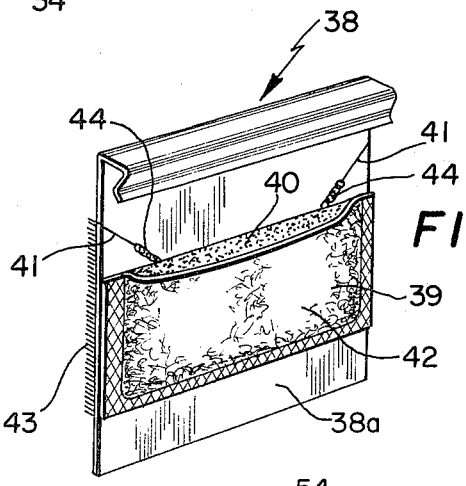
FIG. 5 is a perspective view illustrating a modified form of the invention.

Referring now to FIG. 5, a modified form 38 of the jewelry display device is illustrated and is generally indicated at 38. The display device 38 includes a card 38*a* having a configuration similar to that of card 12 and also includes the rearward extending support member. A foam sheet 39 is bonded to the rear surface of the display card 38*a* but in this form of the invention the foam sheet 39 is bonded to the acetate card on only three edges of its perimeter to form a pouch or envelope 42 having an opening at the top for access thereto. In order to retain a chain in position on the card 38*a*, slits 41 are formed therein and extend diagonally inwardly from the sides of the card toward the center thereof. A flexible decorative layer 43 is adhered to the front surface of the card and it is understood that any attractive decorative flexible layer 43 can be used although a material with a flocked or velvetlike surface has been found to be most effective since it forms an attractive ornamental background for the display of a pendant or other article of jewelry thereon. The jewelry display card 38 is shown in FIG. 5 is preferably used for displaying a pendant attached to a chain or for simply displaying a jewelry chain indicated at 44 in which case a pendant or a portion of a chain is displayed on the front surface of the card using the decorative layer 43 as a display background. The chain is held in place by extending it through the diagonal slits 41 the balance of the chain being retained in the pouch 42 that is formed on the back side of the card 38*a*.

Figure 6:
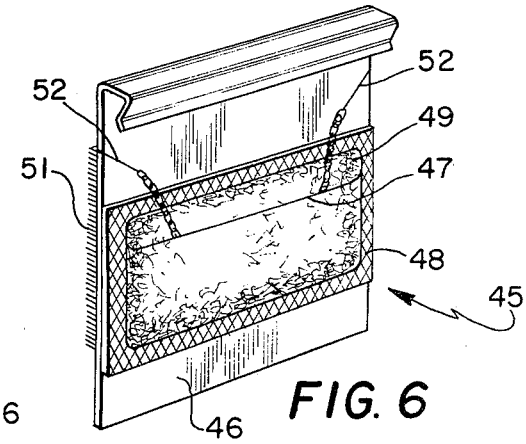
FIG. 6 is a perspective view illustrating a further modified form of the invention.

Referring now to FIG. 6, another modification of the jewelry display device is illustrated and is generally indicated at 45. The display device 45 includes an acetate card 46, the shape and configuration of which are similar to the cards shown in FIGS. 1 and 5. A foam pad 50 is bonded to the rear surface of the card 46 around its entire perimeter as indicated at 48 to form a pouch or container and a decorative layer of plastic material or flocking 51 is attached to the flat surface of the card 46. The foam pad 50 differs from the pad 39 shown in FIG. 5 in that an elongated slit 47 is formed therein that extends across the length of the pad and is spaced from the uppermost edge thereof. The small pouch or envelope as thus formed on the rear side of the card has an additonal top portion 49 included as a part thereof, the slit 47 providing for access to the interior of the pouch formed on the pad 50. The card 46 also has inwardly directed diagonal slits 52 formed on each of the side edges thereof for retaining a chain in place. A jewelry pendant or chain is displayed on the front side of the card using the decorative layer 51 as a background therefore. The chain extends through the diagonal slits 52 and is retained therein. The balance of the chain is held in the flexible foam pouch and is contained therein to conceal it from view. Thus, a pendant or chain can be displayed on the front side of the card without having any of the excess chain detract from the attractiveness of the display.

Figure 7:
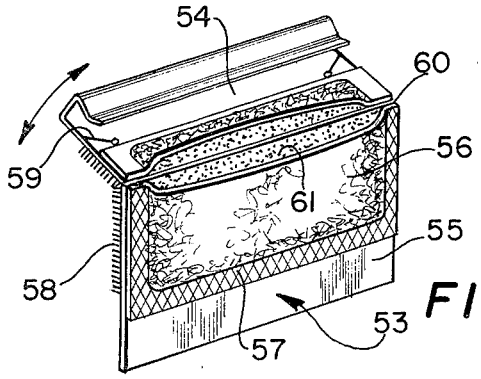
FIG. 7 is a perspective view illustrating a still further modified form of the invention.

Referring to FIG. 7, another form of a diaplay device is illustrated and includes a display card generally indicated at 53. A foam sheet or pad 56 is located on the rear surface of the card and is bonded or sealed thereto around its entire perimeter. A decorative layer 58 is adhered to the front surface of the card to receive an article of jewelry thereon. The card 53 is sectioned by slitting both the foam sheet 56 and the acetate card 55 horizontally thereacross at 60 to form upper and lower portions 54 and 55 respectively thereof. The slit 60 defines an access opening to an envelope or pouch 61 which is formed on the rear surface of the card as a result of said slit, the slit and the decorative flexible layer cooperating to hinge the upper and lower portions of the card relative to each other, thereby facilitating access to the pouch 61. Inwardly directed diagonal slits 59 are formed in the upper portion 54 of the card to receive and retain a chain therein, the remaining portion of the chain being retained in the pouch 61.

Figure 8:
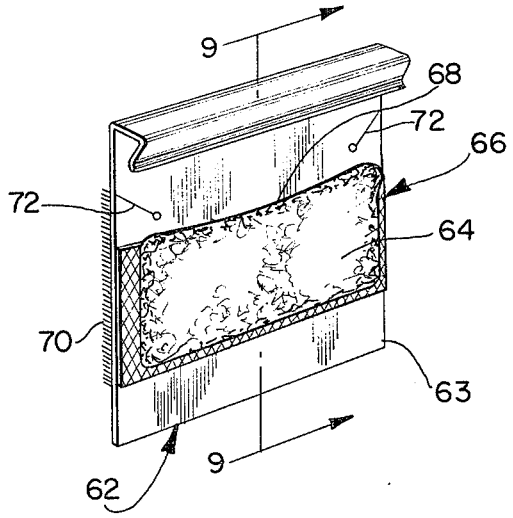
FIG. 8 is a perspective view showing yet another form of the invention.
Figure 9:
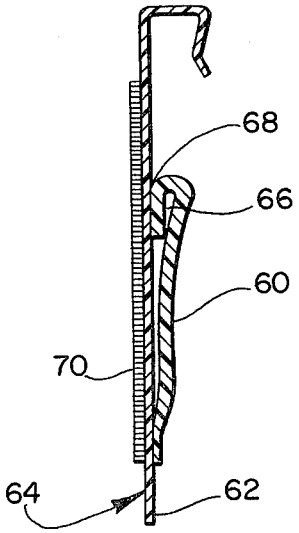
FIG. 9 is a sectional view taken along line 9—9 in FIG. 8.

FIG. 8 illustrates another form of a display device generally indicated at 62 that includes a card 63 that is similar to the card 38*a* illustrated in FIG. 5. However, prior to bonding a flexible foam sheet 64 to the acetate card 63, the foam sheet 64 is doubled over inwardly toward the card as indicated at 66 to form a border of double thickness at the top access opening 68. The doubled over portion 66 strengthens the upper border of the foam sheet so that a chain that is retained in the pouch formed by the foam sheet 64 will be held more tightly so that the chain will be less likely to fall out therefrom when the card is tilted or turned over. Preferably, the foam pad 64 is ultrasonically bonded to the acetate card 63, the bond penetrating through both layers of the foam pad to cause both layers to adhere to each other and to the card. As further shown in FIGS. 8 and 9, a decorative fabric material is secured to the front side of the card 62 and inwardly directed diagonal slits 72 are also formed in the side edges of the card 62 above the foam pad 60. A jewelry chain or pendant with a chain is displayed on the front surface of the card with the chain running through the diagonal slits 72 and retained in the pouch on the rear of the card 64 as previously described in connection with the display device illustrated in FIG. 5. As previously described hereinabove, various hanging means are available for use with the card 62, although the conventional hanger member previously described is illustrated as used therewith.

While there are shown and described herein certain specific structures embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A jewelry display card comprising:

A. a cellulosic card;

B. means for suspending said cellulosic card from a support;

C. a flexible synthetic foam sheet located on one surface of said card with at least a portion of the perimeter thereof bonded to said surface forming an enclosure;

D. access means for permitting entry to said enclosure; and

E. said cellulosic card having slits formed therein that are directed inwardly from opposite edges of said card adapted to receive and retain therein a jewelry chain or the like mounted on said card, the remaining portion of the chain on said one surface being receivable within said enclosure.

2. A jewelry display card as claimed in claim 1, the entire perimeter of said flexible synthetic foam sheet being bonded to the surface of said cellulosic card, said access means comprising an elongated slit extending substantially across said foam sheet.

3. A jewelry display card as claimed in claim 2, said elongated slit extending completely across said foam sheet and cellulosic card and penetrating through the latter, wherein the display card is bendable along a line defined by said slit, said layer defining a hing around which the card is bendable.

4. A jewelry display card as claimed in claim 1, the bond between said sheet and card extending only partially around the perimeter of the sheet, whereby the unbonded portion of the sheet forms said access means.

5. A jewelry display card as claimed in claim 4, the unbonded portion of said sheet being folded inwardly along the access edge to form a band of double thickness of foam therealong.

6. A jewelry display card as claimed in claim 5, the band of double thickness foam also being bonded to the card at either end thereof.

7. A jewelry display card as claimed in claim 1, the bond between said card and said sheet being formed by ultrasonic welding.

8. A jewelry display card as claimed in claim 1, said suspending means comprising an integrally formed flange at the top of said card extending rearwardly and downwardly.

9. A jewelry display card as claimed in claim 1, further comprising a decorative flexible layer on the surface opposite to that on which the foam sheet is fixed.

* * * * *

Disclaimer 4,332,320.—*Jeffrey A. Feibelman,* Cranston, R.I. PENDANT DISPLAY CARD. Patent dated June 1, 1982. Disclaimer filed Apr. 28, 1983, by the assignee, *A & H Mfg. Co.*

Hereby enters this disclaimer to the entire remaining term of said patent.

[*Official Gazette July 5, 1983.*]